US006925734B1

(12) United States Patent
Schaeffer

(10) Patent No.: US 6,925,734 B1
(45) Date of Patent: Aug. 9, 2005

(54) SHOE WITH AN ARCH SUPPORT

(75) Inventor: Michael Schaeffer, Bala Cynwyd, PA (US)

(73) Assignee: Reebok International Ltd., Canton, MA (US)

( * ) Notice: Subject to any disclaimer, the term of this patent is extended or adjusted under 35 U.S.C. 154(b) by 54 days.

(21) Appl. No.: 10/244,588

(22) Filed: Sep. 17, 2002

Related U.S. Application Data

(60) Provisional application No. 60/322,731, filed on Sep. 18, 2001.

(51) Int. Cl.[7] ..... A43B 7/14; A43C 11/00

(52) U.S. Cl. ..... 36/50.1; 36/88; 36/91; 36/166; 36/169; 36/170

(58) Field of Search ..... 36/91, 88, 50.1, 36/145, 166, 169, 170

(56) References Cited

U.S. PATENT DOCUMENTS

| | | | | |
|---|---|---|---|---|
| 545,006 | A | 8/1895 | Baird | |
| 717,523 | A | 1/1903 | Arrowsmith | |
| 730,366 | A | 6/1903 | Gunthrop | |
| 741,826 | A | 10/1903 | Phelps | |
| 859,291 | A | 7/1907 | Grossman | |
| 1,101,747 | A | 6/1914 | McFarland | |
| 1,137,807 | A | 5/1915 | Teehan | |
| 1,185,007 | A | 5/1916 | Scott | |
| 1,200,187 | A | 10/1916 | Greilich | |
| 1,512,033 | A | 10/1924 | Little | |
| 1,602,675 | A | 10/1926 | Hurley | |
| 1,615,496 | A | 1/1927 | Wilder et al. | |
| 1,637,896 | A | 8/1927 | Eddins | |
| 1,649,173 | A * | 11/1927 | McDonough | 36/170 |
| 1,956,703 | A | 5/1934 | Vandewater | |
| 1,976,819 | A | 10/1934 | Weiler | |
| 2,068,251 | A * | 1/1937 | Ullrich | 36/170 |
| 2,070,116 | A | 2/1937 | Cutillo | |
| 2,116,445 | A * | 5/1938 | Moore | 36/170 |
| 2,136,084 | A | 11/1938 | Perugia | |
| 2,149,664 | A * | 3/1939 | Brown et al. | 36/170 |
| 2,188,182 | A | 1/1940 | Gould | |
| 2,191,210 | A * | 2/1940 | Johnson | 36/170 |
| 2,325,639 | A | 8/1943 | Stritter | |
| 2,539,761 | A * | 1/1951 | Whitman | 36/114 |

(Continued)

FOREIGN PATENT DOCUMENTS

| | | |
|---|---|---|
| DE | 1050234 | 8/1959 |

(Continued)

*Primary Examiner*—M. D. Patterson
(74) *Attorney, Agent, or Firm*—Sterne, Kessler, Goldstein & Fox P.L.L.C.

(57) ABSTRACT

The invention relates to a shoe having an arch support extending from an interior of a shoe to an exterior of a shoe. The arch support can be adjusted from the exterior of the shoe. The arch support includes straps which each have a slide groove formed therein. On one end of each strap are strap eyelets. The shoe includes an upper having a slit opening separating an upper paneling and a lower paneling. The arch support is located within the shoe, and extends through the slit opening. Rivets connect the upper paneling and the lower paneling. The rivets are also aligned with and extend through the slide grooves on the arch support. Accordingly, the arch support straps may slide along the rivets to tighten or loosen the arch support within the shoe.

6 Claims, 4 Drawing Sheets

U.S. PATENT DOCUMENTS

| | | | | |
|---|---|---|---|---|
| 2,707,342 | A | | 5/1955 | Maccarone |
| 3,095,656 | A | | 7/1963 | Lipare |
| 3,327,410 | A | | 6/1967 | Park et al. |
| 3,722,113 | A | | 3/1973 | Birkenstock |
| 4,067,123 | A | | 1/1978 | Minihane |
| 4,166,329 | A | | 9/1979 | Herbig |
| 4,227,321 | A | | 10/1980 | Kling et al. |
| 4,322,893 | A | | 4/1982 | Halvorsen |
| 4,510,699 | A | | 4/1985 | Nakamura et al. |
| 4,640,025 | A | | 2/1987 | DeRenzo |
| 4,679,334 | A | | 7/1987 | McBride |
| 4,694,590 | A | | 9/1987 | Greenawalt |
| 4,694,831 | A | | 9/1987 | Seltzer |
| 4,766,682 | A | | 8/1988 | Malloy, III |
| 4,815,222 | A | | 3/1989 | Eisenbach et al. |
| 4,858,338 | A | | 8/1989 | Schmid |
| 4,926,569 | A | * | 5/1990 | Bunch ..... 36/91 |
| 4,962,762 | A | | 10/1990 | Beekil |
| 4,967,750 | A | | 11/1990 | Cherniak |
| 4,972,609 | A | | 11/1990 | Oh et al. |
| 5,323,549 | A | * | 6/1994 | Segel et al. ..... 36/140 |
| 6,393,733 | B1 | * | 5/2002 | London et al. ..... 36/91 |

FOREIGN PATENT DOCUMENTS

| | | |
|---|---|---|
| GB | 336807 | 10/1930 |
| GB | 478322 | 1/1938 |

* cited by examiner

SHOE WITH AN ARCH SUPPORT

BACKGROUND OF THE INVENTION

1. Field of the Invention

This invention relates to an article of footwear, especially for use in athletic activity. More specifically, the invention relates to an arch support for an article of footwear. The invention is an arch supporting strapping system that is tightened or loosened at the exterior of the shoe using the laces of the shoe.

2. Background

An arch region of a foot extends from a point behind the ball of the foot to an area just in front of the heel. The height of the arch in individual feet varies, and is typically referred to as a high arch, a normal arch or a flat arch.

Often, for those who are standing on their feet for extended periods of time or who are exerting their feet, the arch can become sore as it forced to bear loads beyond that which it should normally handle. Accordingly, arch supports have been developed to be placed within a shoe under the arch region of a foot to address this problem. Arch supports provide necessary lift, support and comfort for people who are on their feet for extended periods of time or who are exerting their feet.

Arch supports come in an innumerable number of sizes and shapes and, therefore, are often custom made to provide support for a specific individual's arch. If the arch support is too low, the arch support does not provide sufficient support to the user's foot. If the arch support is too high, the weight of the individual is carried by the arch, causing discomfort and soreness.

What is needed is an arch support system in a shoe that allows a wearer to adjust the support to provide a custom-type fit.

BRIEF SUMMARY OF THE INVENTION

The invention relates to a shoe having an arch support extending from an interior of a shoe to an exterior of the shoe. The amount of support offered by the arch support can be adjusted from the exterior of the shoe. The arch support includes a support region and a strap region, with the strap region having straps that each have a slide groove formed therein. On one end of each strap are strap eyelets.

One end of the arch support is secured within the shoe. The arch support extends across the bottom of the shoe interior and extends through a slit opening to the exterior of the shoe. The slit opening separates an upper paneling and a lower paneling. Rivets connect the upper paneling to the lower paneling. The rivets are also aligned with and extend through the slide grooves on the arch support. Accordingly, the arch support straps may slide along the rivets to tighten or loosen the arch support within the shoe.

The exterior end of the arch support is provided with eyelets. A shoe lace is laced through the eyelets of the arch support and through other typical shoe eyelets. Drawing the lace tightens the shoe around the foot and places the arch support in tension, pulling the arch support against the arch of a wearer's foot, providing support for the arch.

BRIEF DESCRIPTION OF THE DRAWINGS/FIGURES

The foregoing and other features and advantages of the invention will be apparent from the following, more particular description of a preferred embodiment of the invention, as illustrated in the accompanying drawings.

DETAILED DESCRIPTION OF THE INVENTION

The preferred embodiment of the present invention is now described with reference to the figures where like reference numbers indicate identical or functionally similar elements. While specific materials are discussed, it should be understood that this is done for illustrative purposes only. A person skilled in the relevant art will recognize that other materials can be used.

The present invention uses a new strapping system as an arch support. The arch support could be used with any shoe including, among others, athletic shoes, casual shoes, dress shoes, women's shoes and any type of boots. The strapping system provides arch support with the ability to adjust the firmness of the support.

Figure 1:
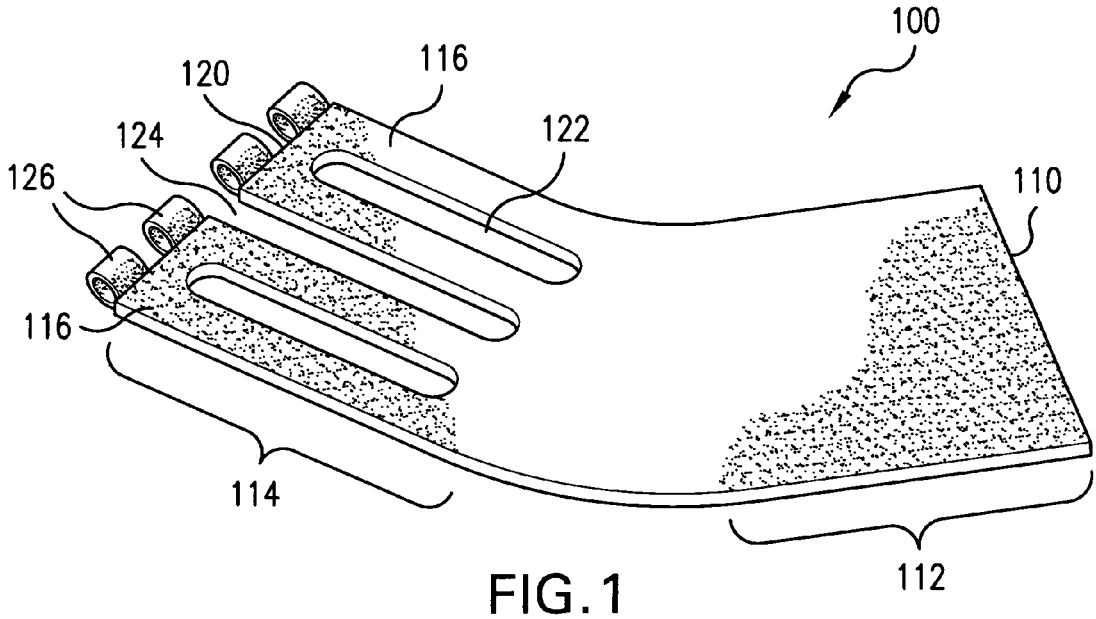
FIG. 1 is an embodiment of the arch support strap of the present invention.

FIG. 1 depicts an arch support 100. Arch support 100 is an elongated strip of material having an interior end 110 and an exterior end 120. Arch support 100 includes a support region 112 and a strap region 114. Support region 112 extends from interior end 110 to strap region 114. Strap region 114 extends from the support region to the exterior end, and includes straps 116. Straps 116 each include a slide groove 122. Slide groove 122 is a through hole, through which objects can protrude. A flex cut 124 extends from exterior end 120 between straps 116 to support region 112. Although flex cut 124 is shown to extend only part way into arch support 100, flex cut 124 could extend from exterior end 120, to interior end 110, dividing arch support 100 into two individual pieces.

Arch support 100 can be of a single material or can be made of more than one material. For instance, arch support 100 could be comprised of one material in support region 112 and a second material in strap region 114. The two pieces could be attached by being glued, bonded, seamed or sewn together, as would be apparent to one skilled in the art. Arch support 100 can be made from virtually any material, including, but not limited to, cotton, nylon, spandex, leather or plastic. In one embodiment, arch support 100 is comprised of a plastic and felt laminate. In a second embodiment, arch support 100 is comprised of plastic and felt along support region 112, and comprised of a stretchable material, such as spandex, along strap region 114. Support strap could also be laminate or a combination of materials.

Arch support 100 includes strap eyelets 126, which are attached to exterior end 120. Strap eyelets 126 can be in the form of loops as shown in FIG. 1, or as hooks, rivets, holes or other attachments, as would be apparent to one skilled in the relevant art. The support strap will now be described in its preferred environment, in a shoe as shown and described with reference to FIGS. 2 and 3.

Figure 2:
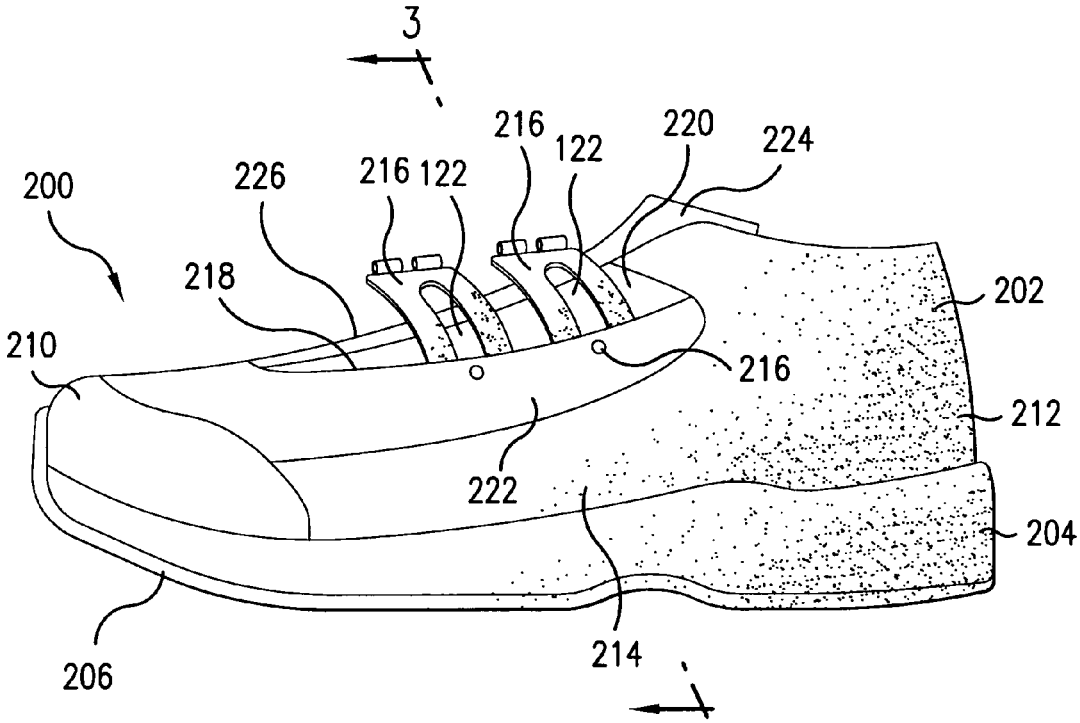
FIG. 2 is an embodiment of a shoe implementing the arch support shown in FIG. 1.
Figure 3:
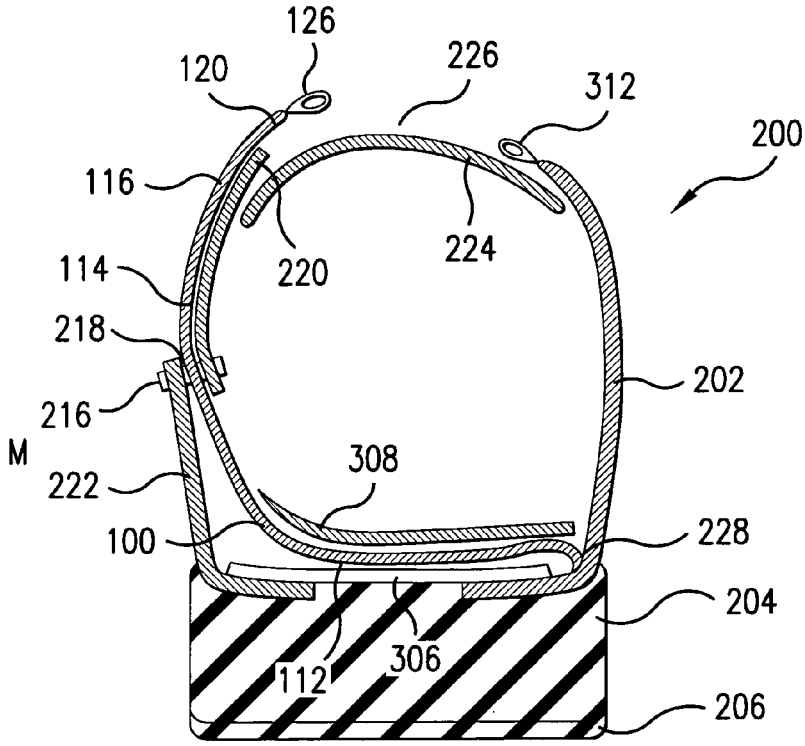
FIG. 3 is a cross section along the line 3—3 of FIG. 2.

FIG. 2 shows the exterior of a shoe implementing the arch support of the present invention. FIG. 3 shows a cross-sectional view taken along line 3—3 of shoe 200 of FIG. 2. Shoe 200 is a view of a medial side of a right shoe. Although shoe 200 depicts the medial side of a right shoe, it will be understood that the invention is equally applicable to the medial side of the left shoe. Shoe 200 includes an upper 202, a midsole 204 and an outsole 206. Upper 202 holds the foot of the wearer to midsole 204, provides a tight and comfortable fit, and prevents sliding of the foot within the shoe. Upper 202 can be constructed in part of leather or other materials having properties similar to leather. Leather and other similar materials usually provide the necessary rigidity for supporting a foot in the shoe. Optionally, upper 202 can be constructed at least in part of various synthetic materials such as polymer meshes. Polymer meshes are light and breathable. Meshes can be advantageous in athletic shoes where a lightweight shoe is important to the athlete's performance during athletic activities, e.g., running and walking events. The mesh also allows the foot to breathe thereby keeping the foot relatively dry during athletic activities. Upper 202 could also be a hybrid-type upper constructed of a combination of the lightweight, more flexible, synthetic materials and stiffer materials such as leather straps and panels for reinforcement.

Upper 202 is secured to midsole 204 in any conventional manner, e.g., by gluing to the upper surface of midsole 204. Midsole 204 provides cushioning and support. Midsole 204 is made of a cushioning material such as polyurethane (PU), ethyl vinyl acetate (EVA) or a polyester elastomer such as HYTREL® foam (made by E. I. du Pont de Nemours and Company of Wilmington, Del.). Attached to midsole 204 is an outsole 206. Outsole 206 can be attached to midsole 204 in any conventional manner, such a gluing, as would be apparent to one skilled in the relevant art. Outsole 206 provides a ground engaging surface designed for traction and support and is typically made of an abrasive resistant material, such as tough rubber, for wear resistance.

Although FIG. 2 shows a separate midsole 204 and outsole 206, it will be understood that any sole may be used in conjunction with the present invention without straying from the spirit of the invention. For instance, shoe 200 could have an outsole, without a midsole. Likewise, midsole 204 of shoe 200 could be provided with windows or other aesthetic or functional designs. Additionally, midsole 204 could house an insert which would aid in providing increased cushioning of midsole 204 through one or more chambers containing air or gas. Again many different sole configurations can be used in conjunction with the invention.

A structural plate 306 separates the interior of shoe 200 from midsole 204. Structural plate 306 can be any material increasing rigidity between the midsole and the interior of shoe, and can be comprised of, for instance, cardboard, plastic, felt, or a composite material, as would be apparent to one skilled in the relevant art.

As seen in FIG. 2, upper 202 includes a heel region 212 and an arch region 214. Upper 202 may have attached thereto foxing 210. Foxing 210 is designed to prevent excessive wear in the toe region of the shoe. Typically, foxing 210 is made of a wear resistant material such as leather.

Upper 202 includes a slit opening 218, separating an upper paneling 220 and a lower paneling 222. Upper paneling 220 extends from a point below slit opening 218 to a throat region 226, in which a tongue 224 is located, as can be seen best in FIG. 3.

Located within shoe 200, and extending across the interior of the shoe and through slit opening 218 is arch support 100. Arch support 100 is attached to the lateral side of the interior of shoe 200 at 228, between structural plate 306 and upper 202. Arch support 100 could be attached by any method, such as being sewed, glued or formed to fit around structural plate 306. Furthermore, arch support need not be attached to the location shown, but can be attached to any location along the lateral region of the shoe.

Support region 112 of arch support 100 is located in the interior of shoe 200, while strap region 114 extends from the interior of shoe 200 through slit opening 218 to the exterior of shoe 200. Rivets 216 connect upper paneling 220 and lower paneling 222, thereby ensuring that slit opening 218 stays a slit rather than becoming a large hole over time. Upper paneling 220 and lower paneling 222 can be spot joined along slit opening 218 by means other than rivets. For instance, upper paneling and lower paneling can be joined by adhesives or sewing, as would be apparent to one skilled in the relevant art. The ends of slit opening 218 can be reinforced from tearing by sewing or other means. Additionally, upper paneling and lower paneling can be joined together in the area of flex cut 124 by rivets or by being sewn, as would be apparent to one skilled in the relevant art.

As can be seen in FIG. 2, rivets 216 are aligned with and extend through slide grooves 122. Rivets 116 do not penetrate straps 116, thereby allowing straps 116 to be remain unfixed to any portion of upper 202. Accordingly, straps 116 may slide in slit opening 218, guided by slide grooves 122 along rivets to raise or lower support region 112 of arch support 100. As such, the height of support region 112 can be controlled or affected from the exterior of shoe 200.

An insole 308 is placed within the interior of the shoe above support region 112 of arch support 100. Insole 308 is typically a preformed, removable cushioning insole. Insole 308 is formed of a foam material having a fibrous cotton or polyester layer on the upper surface. The cotton or polyester layer can be either formed into the foam or glued to the foam to create a laminate. The cotton or polyester surface has a lower coefficient of friction than the foam of insole 308, thereby reducing slipping and sliding of a foot within shoe 200. Insole 308 provides cushioning between the foot and structural plate 306. Insole 308 is typically manufactured with an arch formed into the body of insole 308 to conform to the arch of a foot.

Insole 308 is located above arch support 100 and lies between the bottom of a foot that is inserted into shoe 200 and arch support 100. Insole 308 serves to distribute support offered by arch support 100 across the whole arch area of a foot. This is particularly beneficial at the edges of arch support 100, which provides full support to a location directly adjacent to a fully unsupported location, which could be uncomfortable to a wearer. Additionally, the cushioning provided by insole 308 aids in insuring that arch support 100 is not drawn overly tight, which could, in addition to providing support for the arch, reduce the freedom of movement of certain ligaments and muscles.

Strap eyelets 126 are located across throat 226 from shoe eyelets 312. Shoe eyelets 312 are formed into or attached to upper 202 at throat 226 as would be apparent to one skilled in the relevant art. As described above with reference to strap eyelets 126, shoe eyelets 312 could be in the form of loops as shown in FIG. 3, or as hooks, rivets, punched holes or other attachments, as is known to one skilled in the relevant art.

Figure 4:
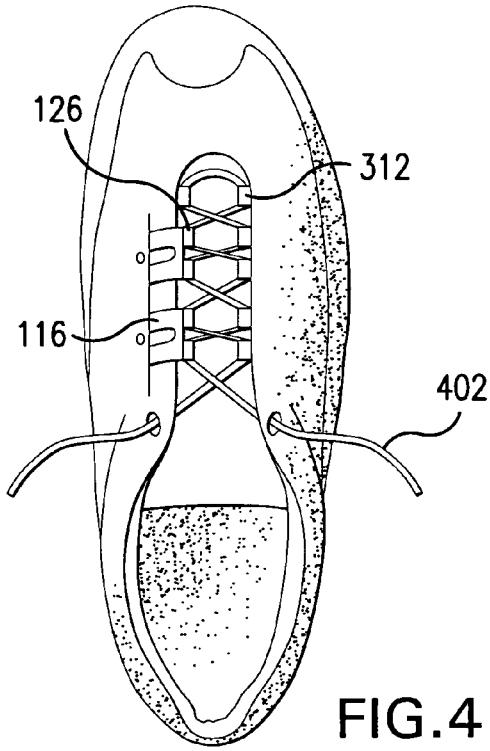
FIG. 4 is a top view of the shoe of FIG. 2 implementing the arch support of the present invention.

FIG. 4 shows a top view of shoe 200 with a shoe lace 402 laced through strap eyelets 126 and shoe eyelets 312. As can be seen, strap eyelets 126 correspond to shoe eyelets 312 to make lacing of shoe 200 simple. Shoe 200 can be tightened around a foot by drawing the two ends of lace 402 tight. Additionally, as lace 402 is drawn tight, straps 116 are pulled in tension, such that slide grooves 122 advance along rivets 116 and support region 112 of arch support 100 is drawn against insole 308 and the arch area of the foot. Accordingly, by drawing the laces, the wearer can draw the arch support around the arch region of his or her foot.

In one embodiment, insole 308 is not included in shoe 200 above arch support 100. Accordingly, as lace 402 is drawn tight, straps 116 are pulled in tension and support region 112 is drawn directly to the bottom of the wearer's foot. This would be beneficial when the wearer desires a tighter support than could be achieved by using insole 308 between the foot and arch support 100. In another embodiment, insole 308 is located below arch support 100, directly against structural plate 306. This embodiment provides increased support for the arch of a wearer while still providing cushioning for the heel and forefoot regions of the foot. Likewise, in this embodiment, insole 308 could be glued or sewn directly to structural plate 306 because it does not adjust or conform with movement of arch support 100.

Figure 5:
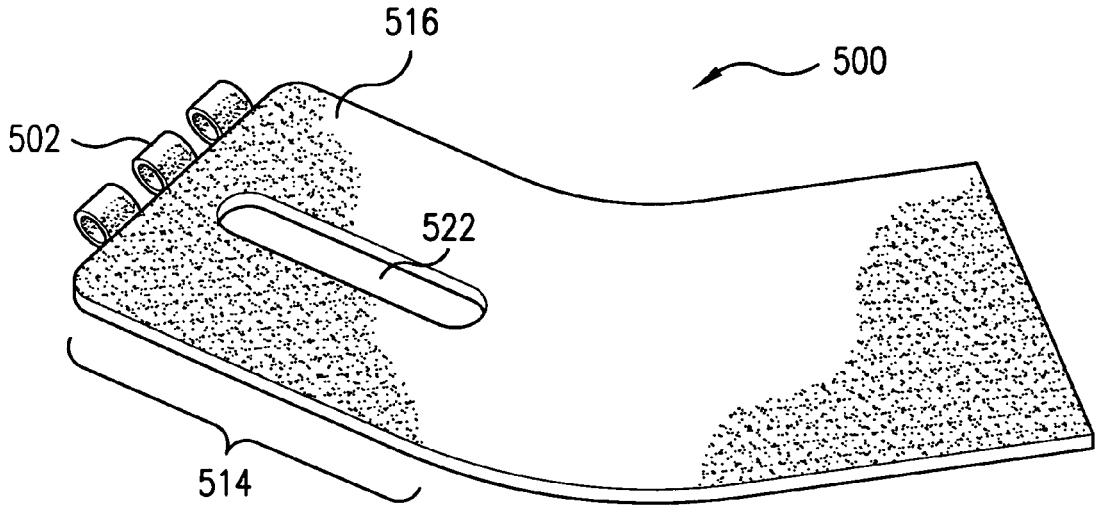
FIG. 5 is another embodiment of the arch support of the present invention.

Another embodiment of an arch support is shown in FIG. 5. In this embodiment, an arch support 500 includes a strap region 514 having only a single strap 516. Arch support 500 includes a slide groove 522 through which a rivet or other fastening device can extend therethrough, as described with reference to previously described embodiments. In this embodiment, arch support 500 includes strap eyelets 502 through which a shoe lace can be laced.

Figure 6:
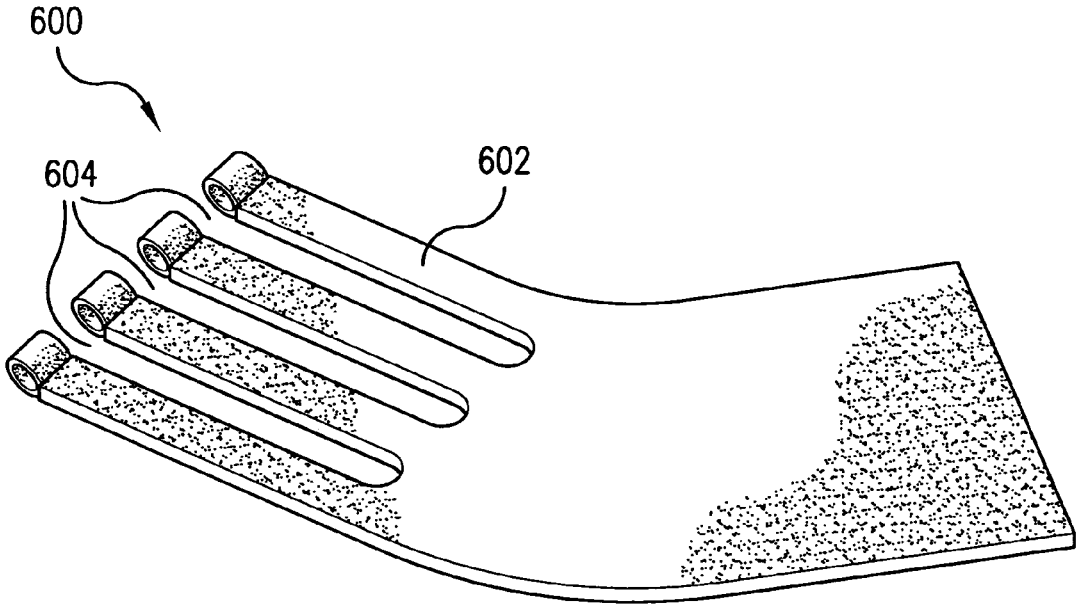
FIG. 6 is another embodiment of the arch support of the present invention.

Another embodiment of an arch support is shown in FIG. 6. In this embodiment, arch support 600 includes four straps 602. Likewise, arch support 600 includes three flex cuts 604. A rivet or other fastening device could extend through one or more of flex cuts 604 to assist in locating and positioning arch support 600 and connecting the upper paneling of a shoe to the lower paneling of the shoe. It would be apparent to one skilled in the relevant art that any number of straps could be used to provide support with the present invention.

Figure 7:
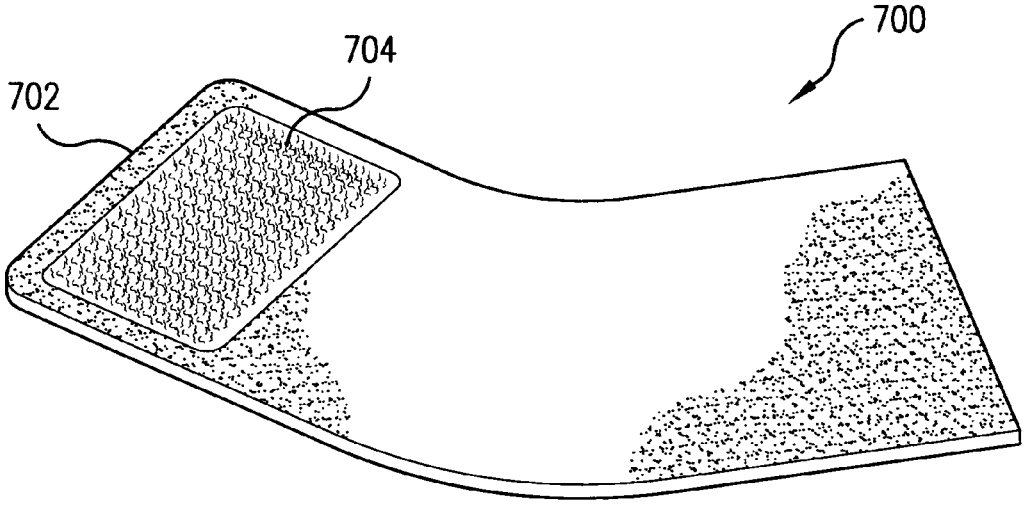
FIG. 7 is another embodiment of the arch support of the present invention.

Another embodiment of an arch support is shown in FIG. 7. In this embodiment, the arch support 700 is a single strip and includes a hook fastener 704 located on an exterior end 702. A loop fastener is located on an exterior of a shoe upper. Unlike the embodiments described above, arch support 700 is not drawn tight by drawing laces. Instead, arch support is drawn tight independent of laces and can attach to an exterior portion of the upper on either the medial or lateral side of the shoe. When arch support 700 attaches to the lateral side of a shoe, arch support 700 extends across an interior bottom of the shoe, through a slit opening to the exterior of the shoe, across the throat of the shoe and attaches to a loop fastener on the lateral exterior of the upper of the shoe. Naturally, hook fastener 704 could be a loop fastener and the exterior of the shoe could include the hook fastener.

Arch support 700 allows the arch support to be adjusted independent of the shoe laces. Thus, support can be comfortably adjusted without regard to the tightness of the laces.

Figure 8:
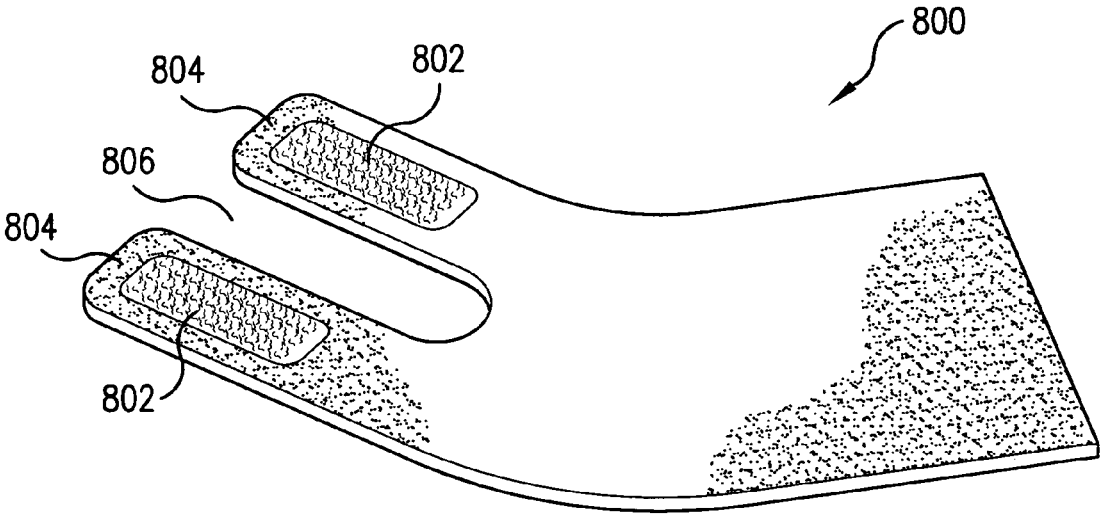
FIG. 8 is another embodiment of the arch support of the present invention.

Another embodiment of the arch support of FIG. 7 is shown in FIG. 8. In this embodiment, an arch support 800 includes either hook or loop material of a hook or loop fastener located on straps 804. A flex cut 806 allows straps 804 to independently attach to the exterior of the shoe.

While the invention has been particularly shown and described with reference to preferred embodiments thereof, it will be understood by those skilled in the art that various changes in form and detail may be made therein without departing from the spirit and scope of the invention.

What is claimed is:

1. An article of footwear comprising:

a sole;

an upper attached to said sole so that said upper and said sole define an interior and an exterior of said article of footwear; and an arch support having a first end anchored to said interior and a second end extending through a slit in said upper, whereby said arch support is adjustable from said exterior and wherein said slit is held together by at least one fastener, said at least one fastener being threaded through a slide groove cut into said arch support, wherein said arch support can slide along said fastener to the extent of said slide groove.

2. The article of footwear according to claim 1, wherein said fastener is a rivet.

3. An article of footwear, comprising:

a sole;

an upper attached to said sole having an opening therein for the insertion of a foot; and an arch support having a first end anchored against said upper and a second end having a closing mechanism for said opening extending through a slit in said upper and closing said opening, wherein said arch support increases as the opening is closed; and at least one fastener to hold together said slit, said fastener being threaded through a slide groove cut into said arch support, wherein said arch support can slid along said fastener to the extent of said slide groove.

4. The article of footwear according to claim 3, wherein said fastener is a rivet.

5. An article of footwear, comprising:

a sole having a medial side and a lateral side, an upper having a medial side and a lateral side, wherein said medial and lateral sides of said upper are adjacent and attached to said medial and lateral sides of said sole, respectively, said sole and upper defining an interior and an exterior of said article of footwear, an arch support having a first end anchored to said interior along said lateral side of said article of footwear and having a second end extending through a slit in said medial side of said upper, wherein said arch support is adjustable from said exterior of said article of footwear and wherein said slit in said medial side of said upper is held together by at least one fastener, said at least one fastener being threaded through a slide groove cut into said arch support, wherein said arch support can slide along said fastener to the extent of said slide groove.

6. The article of footwear according to claim 5, wherein said fastener is a rivet.

* * * * *